United States Patent [19]

Zeigler

[11] 4,280,521

[45] Jul. 28, 1981

[54] HUB ASSEMBLY FOR COLLAPSIBLE STRUCTURES

[76] Inventor: Theodore R. Zeigler, 205 S. Columbus St., Alexandria, Va. 22314

[21] Appl. No.: 49,904

[22] Filed: Jun. 19, 1979

[51] Int. Cl.[3] ..... A45F 1/16; A45B 19/00

[52] U.S. Cl. ..... 135/4 R; 135/20 R; 135/26

[58] Field of Search ..... 135/4 R, 20, 28, 25, 135/26; 52/81

[56] References Cited

U.S. PATENT DOCUMENTS

| | | | |
|---|---|---|---|
| 1,849,794 | 3/1932 | Ericson | 135/28 |
| 2,306,706 | 12/1942 | Lucas | 135/20 R |
| 2,561,435 | 7/1951 | Woodward | 135/28 X |
| 2,571,634 | 10/1951 | Von Gunten | 135/26 |
| 2,830,835 | 4/1958 | Woodruff | 403/193 |
| 3,217,723 | 11/1965 | Suchy | 135/128 X |
| 3,424,180 | 1/1969 | Andolfi | 135/28 X |
| 3,613,702 | 10/1971 | Weber | 135/20 R |
| 3,638,668 | 2/1972 | Kida | 135/26 |
| 3,692,035 | 9/1972 | Houston | 135/20 |
| 3,968,808 | 7/1976 | Zeigler | 135/4 R |
| 4,026,313 | 5/1977 | Zeigler | 52/81 X |

FOREIGN PATENT DOCUMENTS

| | | | |
|---|---|---|---|
| 1806229 | 5/1970 | Fed. Rep. of Germany | 135/26 |
| 685316 | 3/1930 | France | 135/28 |
| 2004715 | 11/1969 | France | 135/26 |
| 595269 | 6/1959 | Italy | 135/28 |
| 26438 | 6/1902 | Switzerland | 135/28 |

*Primary Examiner*—J. Karl Bell

[57] ABSTRACT

A collapsible structural assembly is provided with a plurality of inner and outer hubs pivotally and collapsibly joining the ends of tubular elements making up the structural assembly. Each hub assembly includes a pair of joined hub bodies holding a retaining ring captive therebetween and the hub bodies are slotted to expose sections of the ring. The tubular elements are provided end plugs having slots receiving the ends of connector blades, the opposite ends of which are received in the slots of the hub bodies and are pierced by the ring. The tubular elements are crimped to lock the end plugs and connector blades to them.

4 Claims, 3 Drawing Figures

HUB ASSEMBLY FOR COLLAPSIBLE STRUCTURES

BACKGROUND OF THE INVENTION

This invention relates to collapsible structures of the types disclosed in U.S. Pat. Nos. 3,968,808 and 4,026,313. In such structures, a network of column-like elements are pivotally joined together for movement between a collapsed, compact disposition and an opened condition in which the desired structural shape is formed. The shape may take many forms and may even be an essentially flat structure suitable for use as a panel or the like.

In any event, the column-like elements are arranged in groups having common ends pivotally together as, for example, by the hub assembly illustrated in FIGS. 12–14 of U.S. Pat. 3,968,808 or in FIGS. 13–16 of U.S. Pat. No. 4,026,313. Because of the complex nature of the network of column-like elements and the necessity for pivotally joining the ends of such elements, the hub assemblies must allow not only the basic pivotal motion, but they must also accommodate more complex relative movements among the column-like elements, specifically, for twisting and/or flexing at the hubs. Additionally, for practical and economical reasons, the column-like elements must be readily assembled with the hub structures while, at the same time, each hub assembly must be capable of withstanding many cycles of opening and collapsing the structure without creating or imposing excessive stress and strain on the column-like elements and, in particular on the pivotal connections between these elements proper. Stated otherwise, the hub assemblies must accommodate for twisting and flexure thereat incidental to opening and collapsing movement but they must also impart sufficient ruggedness and strength as to hold the network of elements accurately and rigidly in the opened condition.

BRIEF SUMMARY OF THE INVENTION

The hub assembly disclosed herein is capable of accommodating for the opening and closing of the network without imposing under stress and strain on the pivotal connections between the column-like elements but, at the same time, the construction not only lends itself to economical construction but also allows the use of column-like elements which are of tubular form. In this manner, material costs are lowered and, very importantly, the time and labor necessary to assemble the network with its many hubs is materially reduced.

Basically, the above objectives are achieved by forming the hub proper from a pair of similar bodies which are easily and quickly secured together by adhesive or by fusing. To this end, the hub bodies preferably are made from synthetic resinous material which can be fused by applying a solvent to the mating surfaces which, after brief contact, will cause such surfaces to fuse together, as is well known.

The two bodies present radial slots and, between the bodies, a retaining ring is held captive. The retaining ring pivotally joins the inner ends of blade members to the hub whereas the outer ends of the blade members are provided with plugs received in the ends of the tubular elements. The tubular elements are crimped or otherwise deformed to lock them to the plugs and to the blade members, thus completing the assembly. Clearance of the blades in the hub slots as well as the blade-like configuration allows for twisting and/or flexure movements as well as the pivoting action due to the ring/blade relation.

As well, the hub bodies present a central opening which may receive a plug element having a "cap" or clamping disc to facilitate attachment of a skin structure for the opened network of elements.

BRIEF DESCRIPTION OF THE DRAWING FIGURES

DETAILED DESCRIPTION

As mentioned, the hub assemblies herein are intended for use in any or all of the structures such as are disclosed in U.S. Pat. Nos. 3,968,808 and 4,026,313 and it is to be understood that the structures and disclosures of these two patents are incorporated herein by reference thereto.

Figure 1:
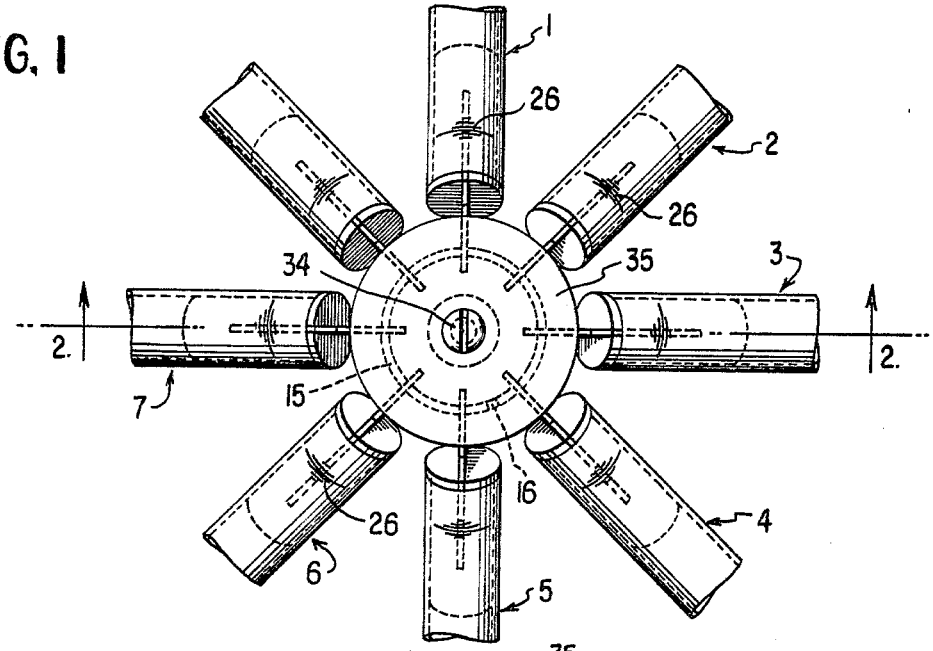
FIG. 1 is a plan view of a hub assembly.

In FIG. 1, a hub assembly which forms an inner or an outer apical point of the referenced patents is illustrated in detail. The column-like elements are indicated by the reference characters 1, 2, 3, 4, 5, 6, 7 and 8 and, as disclosed in the referenced patents they must be at least three in number at each apical points. For each hub assembly as shown in FIG. 1 these will be a corresponding inner (or outer) hub assembly and it is to be understood that pairs of elements 1–8 of the two such assemblies are disposed in crossed relation and will, in the majority of such crossings, be pivotally joined. They also may be slidably joined or they may simply be disposed in crossed relation, all as disclosed in the referenced patents. The crossings and/or joinings of these pairs of column-like elements give rise to compound movements of the ends of the elements to each other and to the hubs incidental to opening and collapsing of the structural network.

Figure 2:
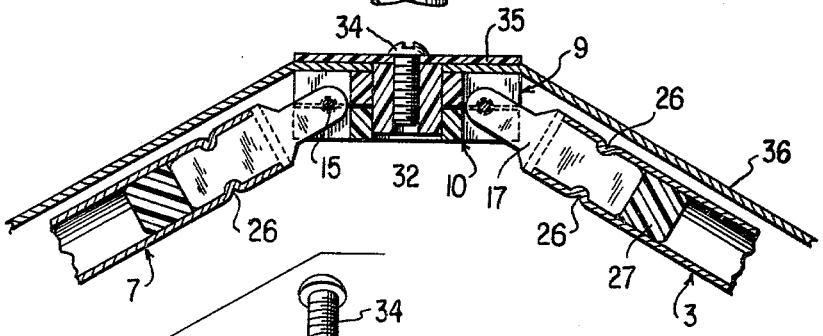
FIG. 2 is a sectional view taken along section line 2—2 in FIG. 1.
Figure 3:
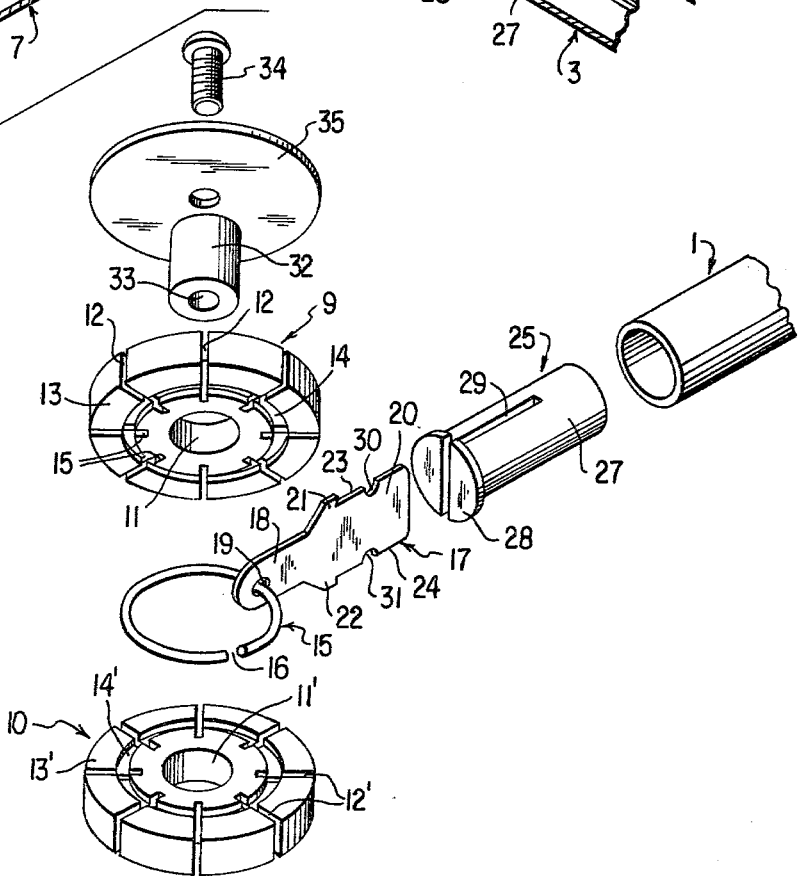
FIG. 3 is an exploded perspective of the hub assembly components.

The hub assembly components are most readily seen in FIG. 3. The two hub bodies 9 and 10 are of similar configuration. The body 9 is of disc-like form provided with a central opening 11 and with a series of radial slots 12. The face 13 of the body 9 is provided with the circular recess 14 which is so located that it intersects the slots 12 adjacent to but spaced outwardly from their inner ends 15. The body 10 is similarly formed with the central opening 11', radial slots 12' and circular recess 14' in its face 13'. As will be evident from FIG. 2, these two bodies are assembled in face-to-face relation with the openings 11, 11', slots 12, 12' and recesses 14, 14' in registry. The faces 13, 13' may be joined by a suitable adhesive, but preferably by fusing the parts together. For this purpose the bodies 9 and 10 preferably are made of a synthetic resinous material which is soluble in an organic solvent and the faces 13, 13' are simply wetted with the solvent and engaged together to form the fusion bond therebetween.

The two recesses 14, 14' hold the retaining ring 15 captive, once the bodies 9 and 10 are joined. The ring 15 is interrupted at 16 to allow the blades 17 to be assembled thereon, one such blade being shown in FIG. 3. Each blade includes the nose portion 18 provided with an aperture 19 which receives the ring 15 with slight clearance. Thus, all of the blades 17 may be assembled on the ring 15 and the ring 15 may then be laid in the recess 14' with the nose portions 18 located in the respective slots 12'. The two bodies 9 and 10 may then be joined, the interruption 16 of the ring 15 being located, as shown in FIG. 1, between adjacent slots 12. The ring 15 may simply be made of round wire which preferably is slightly "pinched" between the two bodies, within the recesses 14, 14', when the bodies are joined.

The anchor end portion 20 of each blade is wider than the nose 18 and merges therewith at the shouldered portions 21, 22. Each nose 18 is long enough to extend radially outwardly from its associated slots 12, 12' and the opposite side edges 23, 24 of the portion 20 are parallel and define a width which is substantially the same as the inside diameter of the associated tubular elements 1–8.

The ends of the tubular elements 1–8 are provided with plug members 25 made of synthetic resinous material which is soft or deformable enough to allow the metallic material of the tubular elements 1–8 to be crimped thereinto as indicated at 26 in FIGS. 1 and 2, thereby locking the plugs in the tubes. Each plug member includes the main body portion 27 of cylindrical form having a diameter to be received snugly but easily within the elements 1–8 and is capped by an end flange 28 having a diameter substantially the same as the outside diameter of the elements 1–8. Further, each plug member 25 is provided with a longitudinally extending slot 29 which recieves and is filled by the end portion 20 of the associated blade member 17. The opposite side edges 23, 24 of the blade are notched as at 30, 31, located a fixed distance from the shoulders 21, 22 and hence at a known position within the elements 1–8 where the plug and blade are fully inserted. Thus, by crimping diametrically opposite sides of the elements 1–8 at these known locations, the crimping 27 not only locks into the plugs 23 but also into the notches 30, 31 of the blade.

In order to secure an inner and/or an outer skin to the structure, a clamping cap assembly may be used. This assembly comprises the synthetic resinous plug element 32 having the base 33 into which the screw 34 may be threaded. The screw holds the cap 35 in place and the flexible sheet or skin 36 is provided with apertures registering with the apertures 11, 11' whereafter the cap assemblies are pressed in place. The plug elements snugly slide into the apertures 11, 11' and sandwich the skin between the cap 35 and the upper (or lower) face of the hub body structure as shown in FIG. 2. It will be appreciated that the hub assembly shown in the drawings forms an "outer apical point" as disclosed in the referenced patents so that the skin 36 is an outer skin but, as well, an inner skin could be provided, attached to "inner apical points".

What is claimed is

1. A hub assembly for collapsible structures comprising, in combination:

a first circular disc-like hub body having a plurality of radially inwardly extending slots therein and having a circular recess on one face thereof which intersects all of said slots in outwardly spaced relation to the inner ends thereof;

an interrupted retaining ring received in said recess;

a second hub body similar to said first hub body and joined in face-to-face relation therewith so that the recesses and slots of said first and second hub bodies are in registry;

a plurality of blade member, each having an apertured inner end receiving said retaining ring and projecting outwardly therefrom through an associated slot to terminate in an anchor end portion outside of said hub bodies;

a plurality of cylindrical plug members, one for each blade member and each having a longitudinally extending slot receiving the anchor end portion of an associated blade member, each such slot extending from one end of its plug member and terminating short of the opposite end thereof; and a plurality of tubular elements, one for each plug member, each tubular element receiving an associated plug member and having at least one deformed portion lockingly engaging both said plug member and the associated anchor end portion, each plug member being snugly received in its associated tubular member and each plug member terminating at said one end thereof in an end flange which is seated against the end of its associated tubular member, the anchor end portion of each blade member being of a width substantially equal to the diameter of said opposite end of the plug member and having notches intermediate its ends, each anchor end portion also having opposite side shoulders seated against said end of its associated tubular element, each plug member being formed of deformable material and each tubular member being deformed inwardly in register with said notches to deform the plug member and force the material of the tubular member locally into said notches.

2. A hub assembly as defined in claim 1 wherein said hub bodies are made of synthetic resinous material and are adhesively secured in said face-to-face relation.

3. A hub assembly as defined in claim 1 wherein said hub bodies are made of synthetic resinous material and are fused together in said face-to-face relation.

4. A hub assembly as defined in claim 2 or 3 wherein said hub bodies are provided with a central opening and including a plug element snugly received in said opening, a clamping disc secured to said plug element, and a flexible skin sheet sandwiched between said clamping disc and one of said hub bodies.

* * * * *